United States Patent [19]

Blaas et al.

[11] Patent Number: 4,711,308

[45] Date of Patent: Dec. 8, 1987

[54] HAND-HELD TOOL WITH VIBRATION DAMPENING

[75] Inventors: Karl Blaas, Buchs, Switzerland; Hansjorg Nipp, Mauren, Liechtenstein

[73] Assignee: Hilti Aktiengesellschaft

[21] Appl. No.: 873,971

[22] Filed: Jun. 13, 1986

[30] Foreign Application Priority Data

Jun. 19, 1985 [DE] Fed. Rep. of Germany ..... 3521808

[51] Int. Cl.[4] ..... E21B 3/00

[52] U.S. Cl. ..... 173/162 R; 173/162 H 16/110 R

[58] Field of Search ..... 173/162 H, 162 R, 139; 16/110 R

[56] References Cited

U.S. PATENT DOCUMENTS 3,824,417 7/1974 Moores, Jr. ..... 173/162 R
4,282,938 8/1981 Minamidate ..... 173/162 H
4,401,167 8/1983 Sekizawa et al. ..... 173/162 H
4,478,293 10/1984 Weilenmann et al. ..... 173/162.1

*Primary Examiner*—Paul A. Bell
*Assistant Examiner*—Willman Fridie, Jr.
*Attorney, Agent, or Firm*—Toren, McGeady & Associates

[57] ABSTRACT

A hand-held tool, such as a hammer drill or chipping hammer, includes a housing with a driving unit for supplying the driving force for the tool with the driving unit generating vibrations. A handle is mounted on the housing and is displaceable in the direction of the main vibration axis. A stop for the forward movement of the handle is provided by an electromagnet. The electromagnet is formed by a yoke, an armature and a magnetic coil and exerts a controlled constant force on the handle and the housing independently of the position of the handle relative to the housing. The electromagnet can be controlled depending on the position of use of the hand-held tool.

8 Claims, 1 Drawing Figure

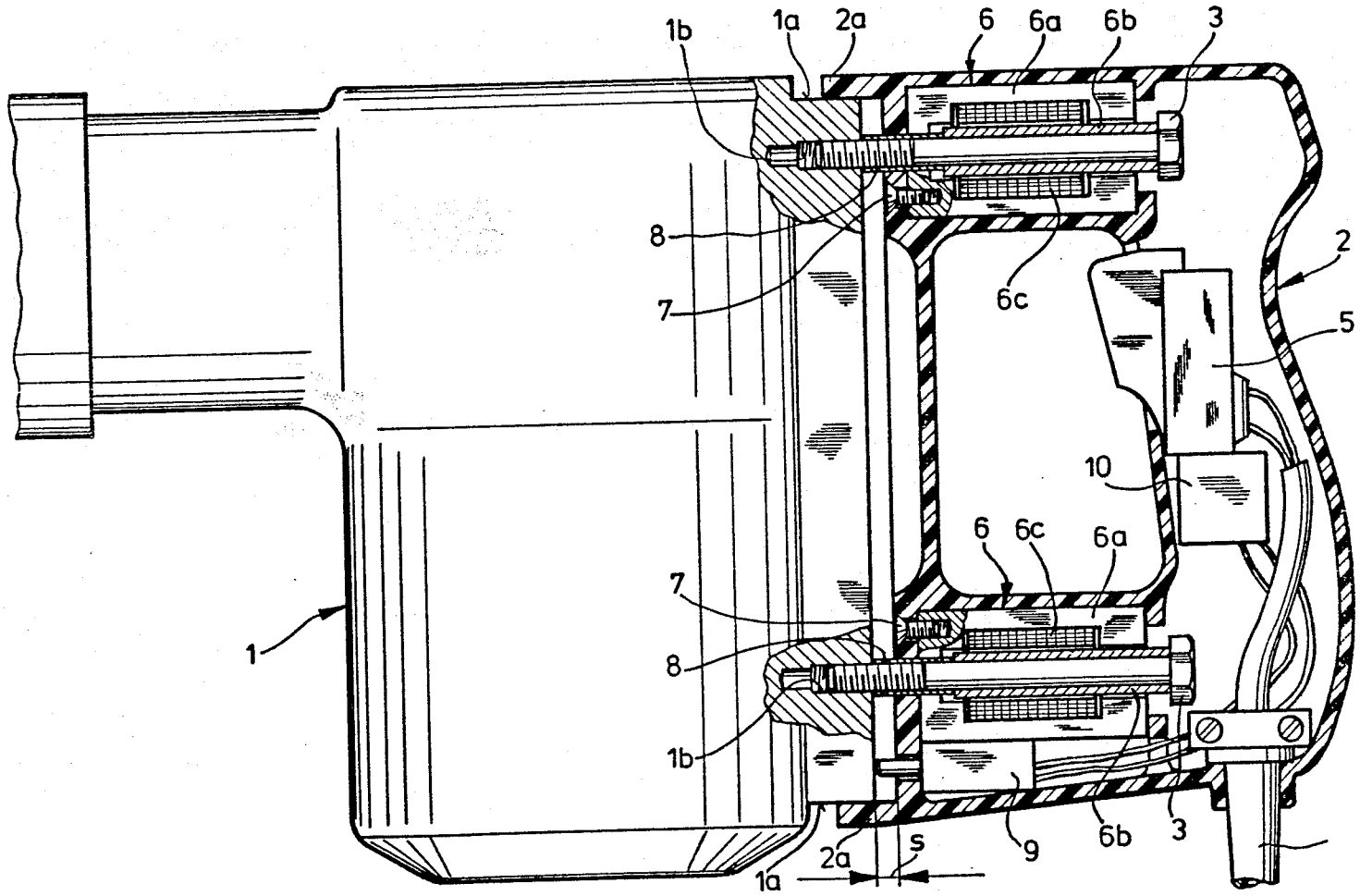
2
5
3
6b
6a
6
6c
10
2a
1a
1b
8
7
9
s
1

HAND-HELD TOOL WITH VIBRATION DAMPENING

BACKGROUND OF THE INVENTION

The present invention is directed to a hand-held tool, such as a hammer, chipping hammer or the like,with a driving unit located within a housing for providing the driving force for the tool and producing vibrations, and a handle connected to the housing and being displaceable in the direction of the main vibration axis between two stops.

Hammer drills and/or chipping hammers with a driving unit which produces vibrations are utilized mainly in the construction trades for drilling and similar working operations. The vibrations generated in the tool can be produced electromechanically, that is, with an electromotor, with a mechanical or electropneumatic percussion mechanism, or pneumatically, hydraulically or electromagnetically for driving such hand-held tools. Due to the reaction forces developed, the vibrations are transmitted in known hand-held tools through the handle to the operator. The stress on the operator's joints and muscles in the operation of such tools can, with time, lead to physical injury. Depending on the type and the operating position of such hand-held tools, the operator must exert a large force of varying extent for maintaining the operation of the tool. With the vibrations developed in the tool superimposed on the contact pressure force required, the operator is exposed to considerable fatigue within a short period of time.

To reduce the transmittal of vibrations through the handle to the operator, it has been known to support the handle on the housing in the direction parallel to the main vibration axis so that the handle is displaceable against the force of spring elements. While such spring elements afford a certain dampening effect, up to the present time it has not been possible to prevent effectively the transmission of vibrations through the handle. A significant disadvantage of such spring elements is that they have a specific natural frequency. Accordingly, a resonance phenomena may develop in the case of changed frequency of the driving unit during operation.

SUMMARY OF THE INVENTION

Therefore, the primary object of the present invention is to provide a hand-held tool, such as a hammer drill or a chipping hammer, with a driving unit which produces vibrations in which the transmission of vibrations from the housing to the handle is effectively dampened.

In accordance with the present invention, the tool handle is provided in the driving or forward direction with a stop in the form of an electromagnet affording a force acting counter to the force directed in the driving direction.

The force of an electromagnet depends on the linked magnetic flux and can be varied within a wide range by the intensity of the electrical current supplied to the coil of the magnet. Electromagnets are often used for the actuation of valves, electric switches and the like and, therefore, are mass-production items which can be fabricated economically in large numbers.

To prevent, as much as possible, the transmission of vibration from the housing to the handle, the force of the electromagnet is maintained constant within a partial range of the displacement travel of the handle. Since hand-held tools often involve high frequency vibrations, the displacement travel of the housing occurring within a single vibration is relatively small and may amount to fractions of millimeters.

As indicated above, the required contact pressure force acting on the hand-held tool depends on the working position of the tool and the type of operation which is being performed. To achieve a defined position of the handle with respect to the housing for the respective working position, advantageously the force of the electromagnet is adjustable depending on the position of the handle. To provide such an adjustment a control circuit is provided determined by a signal based on a travel measuring system of the handle relative to the housing. Thus the distance between the handle and the housing may be large in the case of a small contact pressure force and small in the case of a large contact pressure force.

To attain a constant magnetic force independent of travel, the electromagnet is operated with direct current which remains essentially constant. Since most electrically operated hand-held tools depend for their power from an electrical network normally supplying alternating current, a known rectifier circuit as well as a constant current circuit is required. Where the hand-held tool is not supplied with power from an electrical network, but is operated by rechargeable batteries, the available voltage of the batteries can be used directly for operating electromagnets.

During the movement of the armature relative to the yoke eddy currents are induced in the magnet core. Since such eddy currents impair the characteristic of the electromagnet and affect the vibration dampening effect, the eddy currents should be avoided as much as possible. Advantageously, this can be achieved by utilizing a laminated yoke in the electromagnet. Laminated yokes for electromagnets are known, however, usually they are operated with alternating current. In the present case the yoke is laminated to avoid losses and heating of the iron part because of the eddy currents occurring through the influence of the alternating current.

Another possibility for avoiding eddy currents involves the lamination of the electromagnet armature. Laminated armatures for electromagnets are known and generally are operated by alternating current. In electromagnets operated with direct current, the lamination of the armature and/or the yoke serves to avoid eddy currents generated by the dynamic movements.

To achieve as effective vibration isolation or dampening as is possible, it is necessary that the electromagnet exhibits an approximately horizontal force-travel characteristic, that is, it must exhibit a constant force independent of the travel. This feature can be attained by an appropriate geometry of the armature and the yoke. To avoid losses due to friction caused by contact of the armature with the yoke or the like, precise guidance of the armature in the yoke is required.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

The drawing is a partial side elevational view, partly in section, of a hand-held tool embodying the present invention.

DETAILED DESCRIPTION OF THE INVENTION

In the drawing the hand-held tool consists of a housing 1 and a handle 2. As viewed in drawing the left-hand part of the housing is the forward end and the right-hand part of the housing is the rearward end with the handle 2 connected to the rearward end. The driving direction of the tool is from the rearward end to the forward end and the main vibration axis is in the same direction. At its rearward end, the housing has a projection 1*a* and the handle 2 has a corresponding guidance ring 2*a* laterally enclosing at least a part of the projection 1*a*. Accordingly, handle 2 is connected with the housing so that it is displaceable within limits parallel to the main vibration axis. Two bolts 3 with hexagonal heads connect the handle 2 to the housing 1. The bolts are formed of a non-magnetic material and have a threaded forward end 1*b* threaded into the housing 1 at its rearward end. A supply line 4 is connected to the handle 2 in combination with a switch 5 for actuating the hand-held tool. Two electromagnets 6 are located within the handle 2. Each electromagnet 6 includes a yoke 6*a*, an armature 6*b* guided displaceably relative to the yoke 6*a*, and a magnetic coil 6*c* within the yoke and laterally encircling the armature. The armature 6*b* is a tubular member extending around the bolt 3. Yoke 6*a* is connected to the handle by countersunk screws 7. Each armature 6*b* is connected to the housing 1 by one of the bolts 3 with the armature seated against the hexagonal head of the bolt at one end and extending forwardly to a point where the armature bears against a spacer sleeve 8 with the spacer sleeve extending forwardly into contact with the rear end projection 1*a* on the housing 1. The sleeves 8 are formed of a non-magnetic material. Each armature is clamped between the head of the bolt it encircles and the sleeve 8 which also encircles the bolt. The electromagnets 6 are supplied with direct current which remains essential constant. A measuring feeler 9 is located in the handle 2 below the lower electromagnet 6. Measuring feeler 9 measures the distance S between the housing 1 and the handle 2 in the region of the rearward projetion 1*a*. The feeler 9 provides a signal based on the distance measured which is supplied to a regulator 10 located below the switch 5. The regulator controls the strength of the electrical current flowing through the magnetic coil 6*c*. The control of the current can take place so that with increasing contact pressure force, the distances S become smaller and the current supplied to the magnet coil increases. Within the travel of the housing 1 caused by the vibration developed in the tool, the force of the electromagnet 6 remains largely constant. The strength of the current flowing through the magnetic coil 6*c* or the required contact pressure force can be adjusted externally in accordance with the intended work position of the hand-held tool.

The connection of the yoke 6*a* of the electromagnet 6 with the handle 2 and of the armature 6*b* with the housing 1 is purely arbitrary and could be reversed. The division of the required magnetic force into two electromagnets arranged in parallel with one another is not an absolute requirement and was selected because of the space considerations in the illustrated arrangement.

While specific embodiments of the invention have been shown and described in detail to illustrate the application of the inventive principles, it will be understood that the invention may be embodied otherwise without departing from such principles.

We claim:

1. A hand-held tool used as a hammer drill, a chipping hammer or the like, comprising a housing having a first end and a second end disposed in spaced relation, a driving unit in said housing supplying the driving force with the driving force acting in the direction from the second end toward the first end of said housing and generating vibrations acting along a main vibration axis extending in the direction between the second and first ends of said housing, a handle mounted on the second end of said housing and being displaceably supported in the direction of the main vibration axis between two stops spaced apart in the direction of the main vibration axis, wherein the improvement comprises that said two stops comprises a first stop means on said housing in the region of the second end of said housing for limiting movement of said handle toward said housing and a second stop means within said handle spaced in the main vibration axis direction from said housing for limiting movement of said handle away from said housing, and an electromagnet located within said handle between said first and second stop means and exerting a force acting counter to the driving force of said driving unit, and means are provided for maintaining the force of said electromagnet constant within a portion of the entire displaceable movement of said handle.

2. Hand-held tool, as set forth in claim 1, wherein said means for maintaining the force of said electromagnet constant comprises a measuring device for determining the spacing between the handle and the first stop means housing for controlling the supply of current to the electromagnet.

3. Hand-held tool, as set forth in claim 2, wherein said means for maintaining the force of said electromagnet constant includes a regulator for maintaining the direct current supplied to the electromagnet essentially constant.

4. Hand-held tool, as set forth in claim 1, wherein said electromagnet includes a laminated yoke.

5. Hand-held tool, as set forth in claim 1, wherein said electromagnet includes a laminated armature.

6. Hand-held tool, as set forth in claim 1, wherein bolts secure said handle to the second end of said housing with said bolts extending in the direction of the main vibration axis, said electromagnet comprises a tubular shaped armature laterally enclosing one of said bolts, a yoke located within said housing and located outwardly from said armature, and a coil laterally encircling said armature within said yoke.

7. Hand-held tool, as set forth in claim 6, wherein two said electromagnets are located within said handle extending parallel with the main vibration axis and disposed in spaced relation to one another.

8. Hand-held tool, as set forth in claim 6, wherein said first stop means comprises a projection formed on the second end of said housing and extending in the main vibration axis direction toward and spaced from said handle, and said second stop means comprises a head on said bolt enclosed by said electromagnet with said head located on the end of said bolt remote from the second end of said housing.

* * * * *